United States Patent [19]

Lange

[11] 4,236,397

[45] Dec. 2, 1980

[54] METHOD OF AND APPARATUS FOR PRODUCING COIL SPRINGS WITH EYELETS

[75] Inventor: Gerhard Lange, Reutlingen, Fed. Rep. of Germany

[73] Assignee: Wafios, Maschinenfabrik, Wagner, Ficker & Schmid (GmbH & Co. KG), Reutlingen, Fed. Rep. of Germany

[21] Appl. No.: 940,122

[22] Filed: Sep. 6, 1978

[30] Foreign Application Priority Data

Sep. 15, 1977 [DE] Fed. Rep. of Germany ..... 2741534

[51] Int. Cl.[3] ..... B21F 35/02; B21F 3/02

[52] U.S. Cl. ..... 72/137; 72/424; 140/103; 414/748

[58] Field of Search ..... 72/137, 424, 426, 428; 140/102, 103, 104; 414/745, 748

[56] References Cited

U.S. PATENT DOCUMENTS

| | | | |
|---|---|---|---|
| 3,032,076 | 5/1962 | Bonde et al. | 140/103 |
| 3,192,748 | 7/1965 | Lange | 140/103 X |
| 3,238,977 | 3/1966 | Smith | 140/103 X |
| 3,373,775 | 3/1968 | Reddington | 140/103 |

FOREIGN PATENT DOCUMENTS

| | | | |
|---|---|---|---|
| 1452072 | 5/1969 | Fed. Rep. of Germany | 72/424 |
| 1136735 | 12/1956 | France | 414/748 |

*Primary Examiner*—Ervin M. Combs
*Attorney, Agent, or Firm*—Wigman & Cohen

[57] ABSTRACT

A method and apparatus for producing coil springs formed of wire and with eyelets formed at the ends thereof are disclosed. The apparatus includes a machine for winding spring bodies detachably affixed to apparatus for transferring them from the winding machine to first and second successive eyelet forming stations wherein, at the first forming station, an eyelet is formed at one end of the spring body and, at the second forming station, an eyelet is formed at the other end of the spring body. The spring bodies are divided into transport groups and supply groups arranged side-by-side on upwardly and downwardly inclined ramps, respectively, with their longitudinal axes parallel and at right angles to the transfer direction. Delivery devices are provided between the downwardly inclined, gravity feed supply ramps and the upwardly inclined transport ramps for the stepwise delivery of spring bodies to the eyelet forming stations.

23 Claims, 8 Drawing Figures

192
38
42
190
188
40
192

166
160
156
168
172
164
184
180
42

160
168
170
172
164

156
172
184
180
196
194
176
190
186
190
174
188
186
196
188
194
182
178
180
154

METHOD OF AND APPARATUS FOR PRODUCING COIL SPRINGS WITH EYELETS

BACKGROUND OF THE INVENTION

The present invention relates primarily to a process for the production of spiral springs having eyelets made of wire, wherein a spring body is wound or twisted from a section of wire in a winding station, an eyelet is formed on each end of the spring body in two forming stations, the spring body without eyelets is then transferred out of the winding station into a first forming station and wherein the spring body provided with one eyelet is thereafter transferred from the first forming station into a second forming station. The invention also relates to apparatus for the production of spiral springs having eyelets of wire including a device for winding or twisting a spring body from a section of wire in a winding station, two devices for forming an eyelet on each end of the spring body in two forming stations and a device for transferring the spring body without eyelets from the winding station into the first forming station and for transferring the spring body provided with one eyelet from the first forming station to the second forming station.

A machine of this type, by means of which a process as above-mentioned may be performed, is disclosed in German Pat. No. 1,402,878 (Wafios) comprising a spring winding machine with an additional device to successively handle the two ends of spiral springs independently of the spring winding machine. In the known machine which consists of a spring winding machine and an additional device, the transfer device has two rotating bodies, each of which has four radially movable grippers spaced equally about the periphery and a transfer device arranged between the two rotating bodies, so that the spring body must be individually and successively transferred from station to station. This is, however, subject to the disadvantages with regard to the process, in that the transfer distances between neighboring production stations are unnecessarily long and are dependent on the length of the spring body, that the movable elements of the transfer device must be greatly accelerated and rapidly moved for high productivity, and that the forming and transfer must take place synchronously with the winding. With regard to the machine, the construction is disadvantageously relatively expensive and is heavily loaded, so that the production and maintenance costs are relatively high.

SUMMARY AND OBJECTS OF THE INVENTION

A primary objective of the invention, therefore, is to provide a process of the above-mentioned type, which avoids the described disadvantages.

This objective is achieved according to the invention, in that a plurality of spring bodies, in the same stage of production, are arranged with their axes parallel to each other between two adjacent stations. A transport group of spring bodies formed by at least a few of the plurality of spring bodies is transported in a step-like manner at right angles to the direction of their axes, and the transport group is maintained in a step-like manner by separating out the spring body which has arrived at a forming station and by adding an additional spring body. This achieves, in a relatively simple manner, the advantage that the transfer distances are independent of the length of the spring body and are only slightly larger than the diameter of the spring body. Because of these short transfer distances, the accelerations and speeds of the transferring machine elements are very low even at high productivity rates and the first forming device can operate independently of the winding device, because any desired number of spring bodies can be added to the transport group of a predetermined number of spring bodies, which spring bodies are added in succession to the transport group.

In a preferred method of operation of the process according to the invention, the transport group is formed from only a few of the successively arranged spring bodies and is delivered upwardly. A supply group which is transported further under its own weight is formed from the remaining spring bodies, which supply group is renewed or maintained in a step-like manner by separating the spring body which arrives at the transport group and adding an additional spring body. The supply group accordingly forms a buffer between two adjacent stations, especially between the winding station and the first forming station, so that the wire handling in these stations need not operate synchronously. It is advantageous if the spring body to be separated is moved away by the transport group from an unstable position or point. The choice thereby is to separate the frontmost spring body of the transport group from the other spring bodies.

A further objective of the invention is to provide a machine of the above-mentioned type, which is suited to perform the process according to the invention and requires a low cost with regard to both production and maintenance.

This objective is attained according to the invention in that the transfer device in each transfer interval has at least one angled ramp ending at a forming station and a device for the step-wise delivery of a transport group of spring bodies of the same stage of production which are arranged adjacent each other on the angled ramp with their axes parallel to each other, said delivery taking place in a direction at right angles to said axes. The angled ramp and the delivery device are effective and inexpensive means for carrying out the process according to the invention and require no more than the usual machine maintenance.

In a preferred exemplary embodiment of the machine according to the invention, a plane ramp which leads downwardly in the direction of delivery for a supply group of spring bodies is arranged in each transfer interval and a plane ramp which leads upwardly in the direction of delivery for the transport group of spring bodies is provided which, together with the ramp for the supply group, forms an obtuse interior angle in the intermediate space, through which projects a slide of the delivery device, which pushes the transport group upwardly. The two ramps which form an approximate V-shape and the slide make it possible to form a supply group from the spring bodies next to the transport group in order to carry out the process according to the invention and also make it possible to transfer the transport group in a steplike manner, namely, spring body-by-spring body.

In the preferred exemplary embodiment, a leaf spring is arranged in proximity to the intermediate space of the two ramps, the free end of which is above the upwardly leading ramp and engages between the last and next to last spring bodies of the transport group in a separating manner thus acting as a stop to prevent the spring bodies from traveling backwardly. This return stop assures that the transport group which has been decreased by the separated spring body does not retract so far during the return stroke of the slide that there is insufficient space for the addition of the frontmost spring body of the supply group in the transport group which has been decreased in number.

In the preferred exemplary embodiment, the ramps which lead upwardly in one of the transfer intervals and the ramps which lead downwardly in the following transfer interval are joined along an apex line, which determines the position of a production station. The apex line forms an unstable position or point beyond which the spring body to be separated from the transport group is moved during the preferred method of the process according to the invention. The product station may lie in front of or behind the apex line.

If the two joined ramps are formed in one piece as with the preferred embodiment and are mounted on a horizontal rod in a variable rotational position by means of a holder, they can be easily located and adjusted.

In the preferred exemplary embodiment, the slide of each delivery device is adjustably attached at a pivot arm, which is connected with the pivot arms of the other delivery devices by means of a coupling rod to provide synchronous pivotal motions. The delivery devices have a common drive including a cam means, the cam disc of which is placed upon a control shaft which performs single turns and the lever of which is articulatedly connected with one of the pivot arms. This assures, in a simple manner, that the slides operate synchronously. The adjustable attachment of the slide can be replaced by interrupting the coupling rod between two neighboring pivot arms with a turnbuckle, which makes possible the adjustment of the slide locations. In order to prevent damage to the machine caused by incorrect adjustments, and in order to be able to roughly adjust the delivery stroke of the slide, the cam disc also force-fittingly controls the lever in cooperation with a spring. The lever which is formed as a roller lever is coupled with one of the pivot arms by a connecting strap, and the connecting strap is pivoted at different points on the rolling lever.

In the preferred exemplary embodiment, the control shaft of the transfer device, which performs the single turns, may be driven by means of a gear motor and a belt or chain drive. This type of motor is conventionally available and best utilizes the available structural space, owing to the belt or chain drive. It is, however, also possible, to utilize a conventional gear motor instead or the gear brake motor, the shaft of which drives the control shaft by means of an engagable coupling for each one revolution of the control shaft, which is stopped by a controllable brake.

It can be selectively provided in the machines according to the invention, the winding devices of which have control shafts which perform the rotations, that the control shaft of the cam mechanism is the control shaft of the winding device and that the lever of the cam device is coupled with one of the pivot arms by a linkage. This simplifies the drive of the delivery devices.

The preferred exemplary embodiment of the machine according to the invention is distinguished in that the two forming devices are identical and are arranged on opposite longitudinal sides of the ramps in the direction of delivery and are staggered as a first and a second forming device. This arrangement makes it possible to avoid turning each spring body after leaving the first forming station and before it arrives in the second forming station. The identical formation of the two forming devices substantially simplifies the production and adjustment of the machine.

The first and second forming devices of the preferred exemplary embodiment are mounted on a first or second horizontal rod and are supported by means of a strap on such rods. The two rods also serve to mount two pairs of ramps each by means of a holder and also simplify the mounting of the forming devices in a certain angular position.

In the preferred exemplary embodiment, each forming device has a controllable detaining device, which is capable of a reciprocating motion at right angles to one of the joined ends of the ramp (a ramp pair), and cooperates with an arm arranged in a ramp section to grip a spring body. The detaining device and/or the arm is provided with a fluted profile adapted to the diameter of the spring wire as well as to the outside diameter and the pitch of the spring body, so that a spring body which is held in place but not yet clamped can be rotated about its axis like a screw, in order to attain a certain rotational and axial position.

In the preferred exemplary embodiment, each forming device has, in addition, a controllable stop, which can be moved back and forth in a direction at right angles to one of the joined ramp ends. This stop is to prevent a spring body separated from a transport group from unintentionally departing the forming station by rolling down the ramp when it is no longer supported by the usual spring bodies.

In the preferred exemplary embodiment, it is provided that the stop is located at the associated detaining device, i.e., the detaining device associated with the same forming station, that the detaining device and the subsequent stop, as viewed in the direction of delivery, of the one, namely the first, forming device are arranged at the upper end of a downwardly leading ramp, and that the stop and subsequent detaining device, as viewed in the direction of delivery, of the other or second forming device are arranged at the upper end of an upwardly leading ramp. In this manner, a controlling of the stop independently of the control of the detaining device is eliminated. This is simply co-controlled. The chosen alternating succession of detaining device of both forming devices is not lost by adding the co-control stops. The two forming devices can be selectively arranged in such a manner that they are located either in a space-saving manner in one and the same transfer interval or in two different transfer intervals, which are separated from each other by a further transfer interval. The first alternative is effectuated in the preferred exemplary embodiment.

Each forming device of the preferred exemplary embodiment is provided with a device for rotating the transferred spring body about its axis into a rotational position in the forming device determined by a stop. A rotating device is necessary if the rotational position of the spring body which is positioned in a forming device is not coincidentally the desired rotational position, in which the bending tool of the forming device is to act on the end of the wire of the spring body. If the two rotational devices are identical, as in the preferred exemplary embodiment, and the two forming devices are arranged opposite each other on the longitudinal sides of the ramp as first and second rotating devices, the machine production is simpler and the two rotational devices together with the two forming devices form a compact package.

In the preferred exemplary embodiment, each rotational device has a pneumatic rotator which can be shifted back and forth along the axis of the spring body to be rotated with a receiving element for one end of the spring body, which acts on the wire end or the eyelet of this end. A stud with a radial carrier pin or a hollow body with an interior radial carrier pin are preferably provided as the receiving elements in the first and second rotational devices. The carrier pins engage in the first forming station on one end of the wire of the spring body or in the second forming station on the already formed eyelet.

Each rotational device of the preferred exemplary embodiment has a pneumatic piston-cylinder arrangement, the purpose of which is to move its associated pneumatic rotator, the piston rod of such arrangement being rigidly connected with the pneumatic rotator. By alternately controlling the piston-cylinder arrangement, the pneumatic rotator can be moved in the desired direction.

In the preferred exemplary embodiment, the two piston-cylinder arrangements of the first and second rotational devices are arranged on a first or a second arm and the first and second arms are mounted on the second or first rods, and are supported by means of a strap on the first or second rods. This simplifies the mounting of the piston-cylinders of both rotational devices with the aid of the two aforementioned rods.

In the machine according to the invention, the winding device of which as in the preferred exemplary embodiment is a structural unit, the two forming devices and the transfer device can form a structural additional unit, which is detachably connected with the winding device. This provides the advantage that the additional unit can be produced separately and subsequently added and can also be temporarily removed, when adjustment or maintenance operations must be performed on the winding device. The additional unit advantageously has a chassis or frame with at least three self-operating supporting rollers and a pole, which is pivoted at the housing of the winding device by means of bolts and a strap. Accordingly, the additional unit can be pivoted away from the winding device about the bolt axis or moved away with the aid of the pole after the bolts have been removed. The chassis can have a rotating foot in place of a fourth supporting roller, said foot being anchored in the floor. After the bolts have been removed, the additional unit can be pivoted away from the winding device about the point of rotation formed by the foot.

Finally, in the preferred exemplary embodiment, the inclined ramp of the transfer device which begins at the winding station is arranged so as to be adjustable both with respect to height and angle inclination by means of two adjusting rings which are placed on the pole and two supports which are pivoted on one end at the ramp and on the other end at the adjusting rings. This arrangement of the first inclined ramp advantageously utilizes the pole as a support and makes possible a broad adaptability of the additional unit to the distance of the first forming station from the winding station and to their difference in height.

BRIEF DESCRIPTION OF THE DRAWINGS

In the following, the invention is described in greater detail with the aid of the preferred exemplary embodiment of the invention shown in the drawings as an example as well as variations thereof, wherein.

DETAILED DESCRIPTION OF PREFERRED EMBODIMENTS

Figure 1:
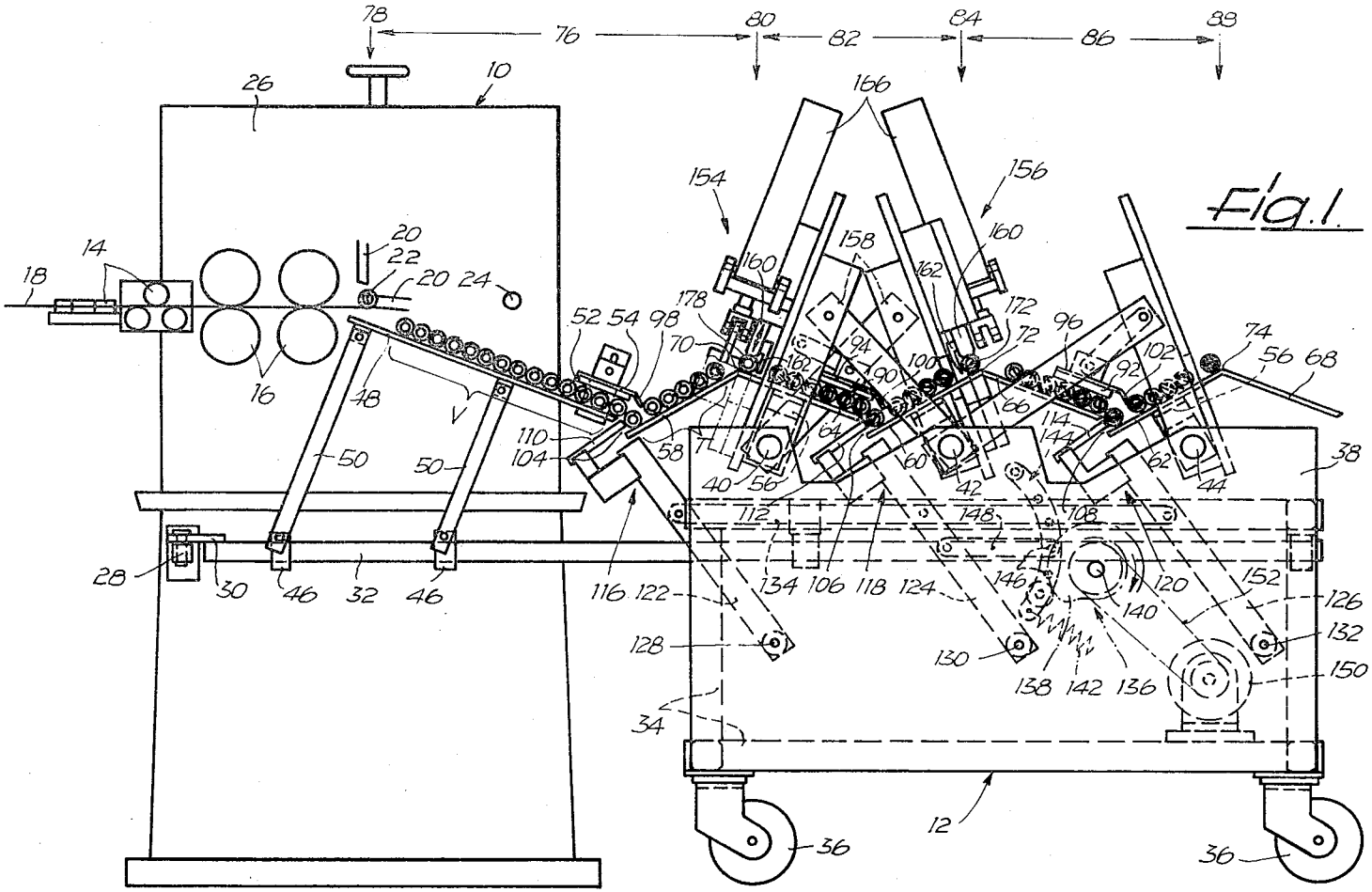
FIG. 1 is a partially simplified front view of the exemplary embodiment.

The exemplary embodiment according to FIGS. 1 through 7 consists of two detachably connected elements, namely, the stationary structural unit of the winding device 10 and the movable structural additional element 12 having several devices and apparatuses which are described hereinbelow.

The winding device 10 is known and includes guide rollers 14 and pinch rollers 16 for a wire 18, which is supplied to the winding and cutting tools 20, which produce a spring body 22 from the wire, which spring body has a certain wind ratio and a certain length. The tools 20, to the extent they are movable, are controlled by a control shaft 24. The spring body 22 is produced externally of a housing 26 without the use of a winding mandrel, so that after cutting the wire 18 at the last-formed end of the spring body, the spring body is free to fall downwardly to a receiver and, thus, is supplied to a rear end of a supply group, without passing through any intermediate hopper or container.

A joint with a removable bolt 28 is arranged beneath the tools 20 on the same side of the housing 26, and a strap 30 is rotatably mounted on this joint about a vertical axis. The strap 30 is disposed on the front free end of a horizontal pole 32 of the additional unit 12. The pole 32 is attached approximately in the center of a chassis 34 of the movable additional unit 12 which is generally square in cross-section. The chassis 34 is provided with four self-controlling supporting rollers 36, which are located on the four corners of the frame. Two parallel mounting plates 38 are arranged on two opposite sides of the chassis 34, to which plates 38 are attached three rods 40, 42 and 44 which lie above and transverse to the pole 32.

Two adjusting rings 46 bear on the section of the pole 32 which extends parallel to the housing 26 of the winding device 10, above which is arranged a straight, downwardly leading first ramp 48. Two supports 50 which are pivoted both at the two adjusting rings 46 as well as at the lower side of the ramp 48 allow an adjustment of the height and inclination of the first ramp 48, the upper end of which lies closely beneath the tools 20 of the winding device 10, so that the finished spring body 22 can roll or slide down the ramp, whereby it is discharged from the winding device 10, is supplied to a rear end of a supply group, and approaches the additional unit 12. A hold-down device 52 which is adjustable in height relative to ramp 48 is attached at the lower end of the first ramp 48, and supports a leaf spring 54 the purpose of which will be explained below.

A holder 54 is arranged on each of the parallel rods 40, 42 and 44 in a variable rotational position, which holder holds a one-piece ramp combination, which consists of a straight, upwardly leading ramp 58, 60 or 62 and of a straight, downwardly leading ramp 64, 66 or 68. In this manner, the upwardly leading ramp and the downwardly leading ramp form a horizontal apex or dividing line 70, 72 or 74, along which the two ramps are joined and at which the two associated ramps form an obtuse interior angle.

All ramps are made of a material such as bent sheet metal strips and can be replaced by similar ramps having a different width.

The first downwardly leading ramp 48 together with the first upwardly lading ramp 58 forms a first transfer interval 76, which lies between the winding station identified by arrow 78 and a first forming station identified by arrow 80. Accordingly, the second downwardly leading ramp 64 and the second upwardly leading ramp 60 also form a second transfer interval 82, which lies between the first forming station 80 and a second forming station identified by arrow 84, and the third downwardly leading ramp 66 and third upwardly leading ramp 62 form a third transfer interval 86, which lies between the second forming station 84 and an unoccupied third production station identified by arrow 88. The series of stations is continuous with a pair of ramps defining a transfer interval and the last ramp, in the exemplary embodiment ramp 68, forming a discharge, which can terminate above a collecting container.

At the lower end of the two downwardly leading ramps 64 and 66 are arranged hold down elements 90 and 92 the elevation of which is adjustable. Each of the hold down elements 90 and 92 carries a leaf spring 94 or 96 which is similar to the leaf spring 54. The bent free ends 98, 100, and 102 of the three leaf springs are arranged directly above the upwardly leading ramps 58, 60 and 62, whereby the vertical distance is adapted to the outside diameter of the spring bodies 22 being smaller than said outside diameter. The distance can be changed as desired without any difficulty by lifting or lowering the hold down elements 52, 90 and 92.

At each transfer interval the downwardly leading ramp and the upwardly leading ramp form an obtuse interior angle and an interior space 104, 106, 108, through which projects a slide 110, 112, 114, of a delivery device 116, 118 and 120. The relative arrangement of the two ramps is thereby chosen in each transfer interval in such a manner that an extension of the downwardly leading ramp would intersect the lower end of the upwardly leading ramp. The pushing distance of the slide is the same in all transfer intervals and runs basically parallel to the plane of the upwardly leading ramp.

In the rest position of the slides as shown in FIG. 1, their distance from the free ends of the leaf springs 98, 100 and 102 is somewhat larger than the outside diameter of the spring body 22. In their extended or work position, in contrast, the slides extend to the ends of the leaf springs.

Each of the identical delivery devices 116, 118 and 120 has a pivot arm 122, 124, 126, the upper end of which adjustably supports the associated slide and the lower end of which is pivotably mounted on one of three parallel horizontal axes 128, 130 and 132, which extend between the two support plates 38 of the additional unit at the same elevation. A horizontally arranged coupling rod 134 is articulated on all three pivot arms, so that the pivot arm perform synchronous pivotal movements, as a result of which the three slides are activated simultaneously. The three delivery devices 116, 118 and 120 comprise a common drive with a cam mechanism 136, the cam disc 138 of which is located on a horizontal control shaft 140 which performs single turns. The ends of the control shaft 140 are rotatably mounted on the two mounting plates 38. A roller lever 144 which bears on and is controlled by the cam disc 138 of the cam mechanism 136 with the aid of a spring 142 is formed in the shape of a dish and has several bores 146. A connecting strap 148 is articulated on one end at the center pivot arm 124, and on the other end at a selected bore location of the roller lever 144. By changing the bore location, the delivery stroke can be simultaneously changed for all three slides 110, 112 and 114.

The control shaft 140 can be driven with a chain drive 152 by means of a gear brake motor 150 which is mounted on the chassis 134. Said chain drive 152 consists of two sprockets and a chain. The motor 150 is energized by means of a trip dog which is located on the control shaft 24 of the winding device 10 and is deenergized by means of a trip dog which is located on the control shaft 140 of the additional unit 12, in that the two trip dogs (not shown) activate electrical switches.

The first forming device 154 and an identical second forming device 156 are staggered on opposite longitudinal sides of the ramps in the direction of delivery and above the imaginery extensions of the apex lines 70, 72, so that each of the two devices can form the end of the wire on the spring body into, for example, a German eyelet. The first and second forming devices 154 and 156 are mounted at the first and second rods 40 and 42, respectively, and are supported on the second and first rods 42 and 40, respectively, by means of a strap 158 in such a manner that they are inclined toward each other, as shown in FIG. 1. Each forming device has a holding device 160 which can be controlled by the shaft 140 and a stop 162 located thereon both of which serve to position a spring body in the respective forming station. An arm 164, which is arranged in a ramp section at the upper end of the downwardly leading ramp 64 or the upwardly leading ramp 60, assists in positioning the spring bodies and cooperates with the associated holding device 160 to clamp a spring body. In addition, the lower side of each holding device 160 is provided with a grooved profile, which can be adapted to the arms 164. The holding device 160 of the first forming device 154 is reciprocated perpendicularly to the upper end of the downwardly leading ramp 64, while the holding device 160 of the second forming device 156 is reciprocated perpendicularly to the upper end of the upwardly leading ramp 60. The stops 162 of the two forming devices are located, as seen in the direction of inclination of the ramps 64 and 60, adjacent of the two holding devices 160, so that a spring body which has not yet been clamped cannot roll or slide down the ramp. The immovable tools and the tools which are movable by means of pneumatic cylinders 166 or are controllable by the control shaft 140 of the two forming devices need not be described in further detail, because their form, arrangement and method of operation is known. Significant here is only a rotation stop 168, against which the wire end 170 of a spring body 172 which is rotating between the holding device 160 and the arm 164 strikes.

Figure 2:
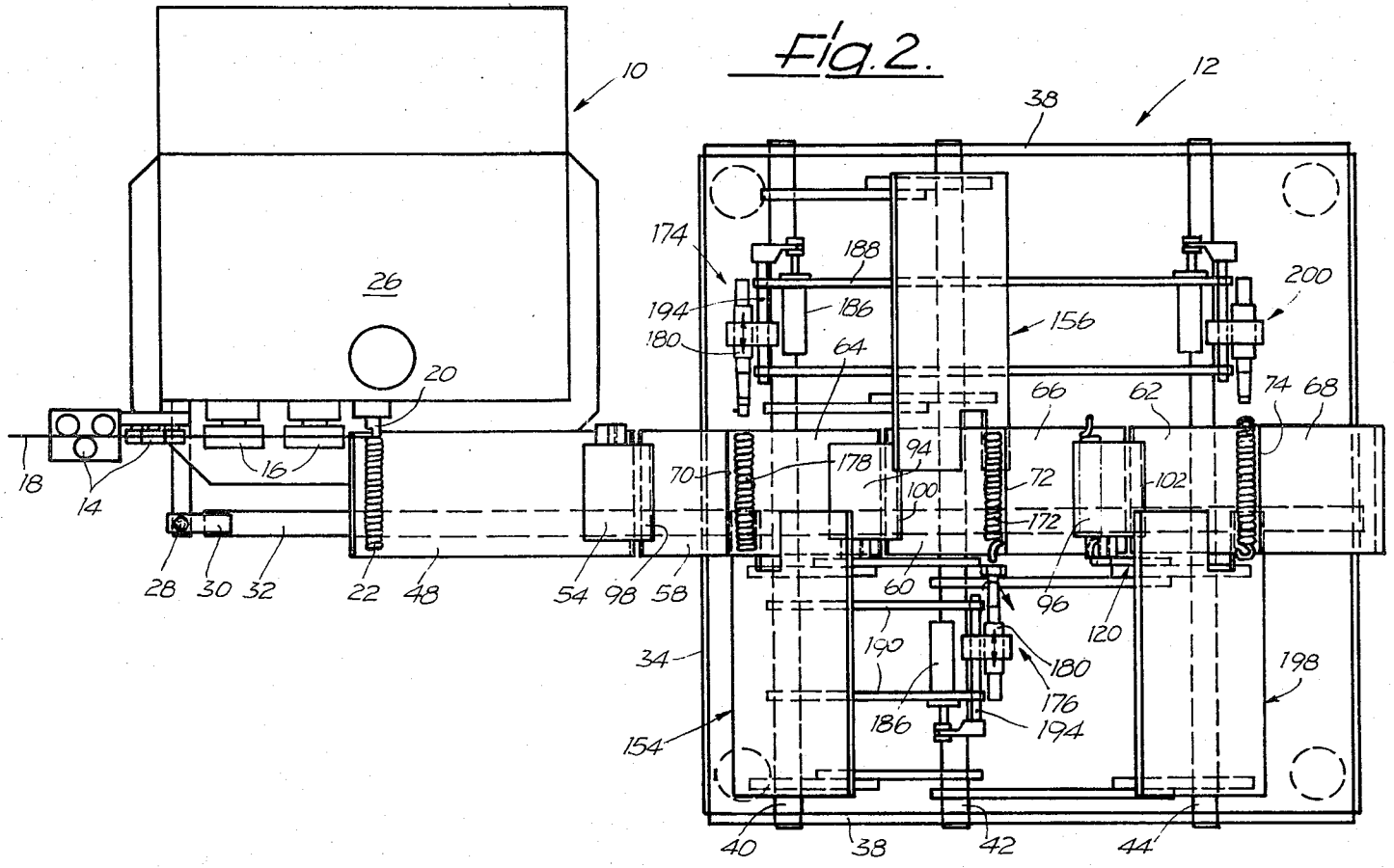
FIG. 2 is a top view of that shown in FIG. 1.
Figure 3:
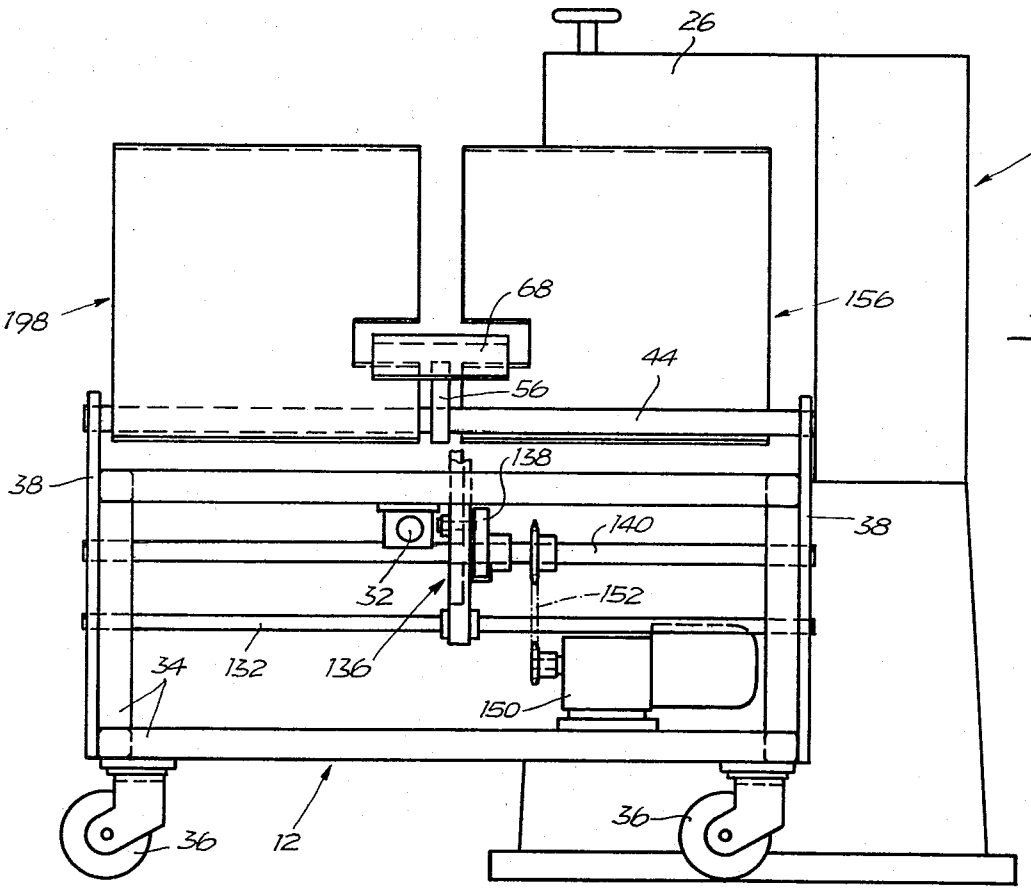
FIG. 3 is a side view of the exemplary embodiment.
Figures 4, 5, 6, 7:
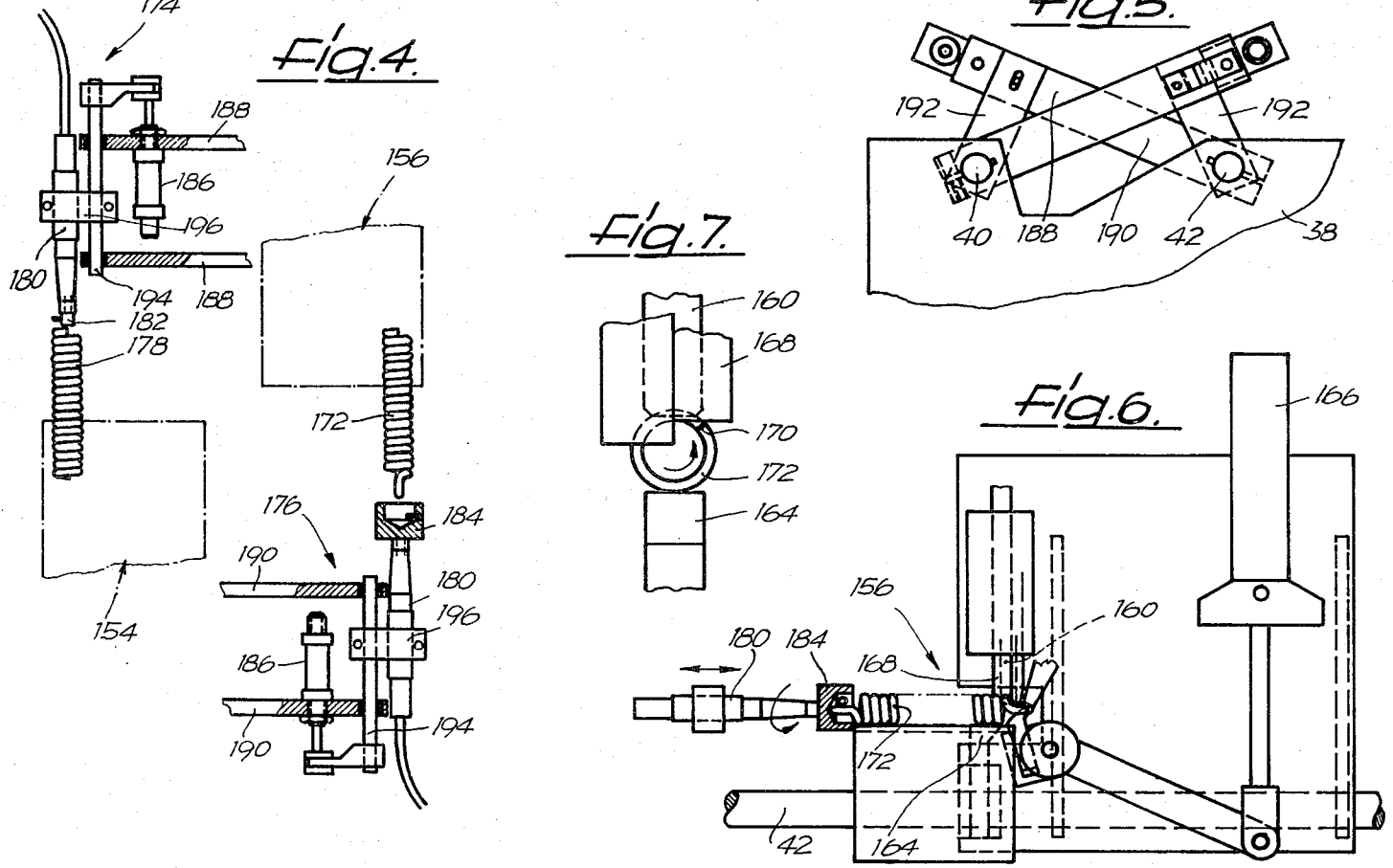
FIG. 4 is a top view of two rotational devices of the exemplary embodiment.
FIG. 5 is a front view of the two rotational devices.
FIG. 6 is a side view of a second forming device of the exemplary embodiment.
FIG. 7 is a detail of the forming device.

The two forming devices 154 and 156 are each provided with a device 174, 176 for the rotation of a spring body 178, 172, which is transferred into the first or second forming stations, about its axis into a rotational position determined by the stop 168 in the forming device 154, 156. The two rotation devices are identical and are arranged opposite the two forming devices on the longitudinal sides of the ramps as first and second rotational devices 174, 176, as shown in FIGS. 2 and 4. Each rotational device has a pneumatic rotator 180 which can be reciprocated along the axis of the spring body to be rotated. The pneumatic rotator 180 has a receiving element 182, 184 for an end of the spring body 178, 172, which engages the wire end or the eyelet of this end. A stud having a radial carrier pin or a hollow body with an interior radial carrier pin are provided as receiving elements 182 and 184. A pneumatic double-acting piston-cylinder arrangement 186 is provided for both rotation devices to reciprocate the pneumatic rotator 180. The cylinder of the arrangement 186 is arranged between two parallel first arms 188 or two arms 190 and is mounted on one of the arms. The first and second arms 188 or 190 are, in turn, mounted on the second or first rods 42 or 40 and are each supported by means of a strap 192 on the respective first or second rods 40 or 42.

The piston rod of each arrangement 186 is connected outside the space between the two arms 188 or 190 with a slide rod 194, which is slidably mounted at the arm and is rigidly connected with the pneumatic rotator 180 be means of a clamp 196.

The two pneumatic rotators 180 each have an adjustable torque and are placed in operation as soon as the receiving element 182 or 184 is axially loaded by the spring body 178 or 172 being held in place. The activation and air discharge of the double-acting piston-cylinder 186 is controlled by the control shaft 140.

The third production station 88 is not provided with a forming station in the exemplary embodiment according to FIG. 1, but can, as shown in FIG. 2, comprise a further forming station, in which a post-formation device 198 and a third rotational device 200 are arranged.

When a sufficient number of spring bodies is collected with horizontal parallel axes next to each other in all three transfer intervals, the spring bodies lying on the downwardly leading ramps form supply groups V and the spring bodies lying on the upward leading ramps form transport groups T. Both groups are delivered in a step-like manner at right angles to the direction of their axes and parallel to the ramps. This takes place for the transport groups T with the assistance of a slide. The supply groups V can move forward under their own weight.

The method of operation of the above-described exemplary embodiment according to FIGS. 1-7 is basically as follows: Before the machine is placed in operation for the first time, an operator places, on each ramp except the discharge ramp 68, as many spring bodies of the proper production stage, as forms a complete supply and/or transport group V or T in each transfer interval. When the operation of the machine is later interrupted and again resumed, this step is no longer necessary.

In its rest position, the slide in each transfer interval prevents the spring body lying at the lower end of the upwardly leading ramp from falling from the ramp through the intermediate space present at the lowest point of the transfer area. After the gear brake motor has been turned on, the slide performs a transport stroke, whereby it pushes the spring body lying at the lower end of the upwardly leading ramp past the end of the adjacent leaf spring up the ramp. This spring body, in turn, pushes against the other spring bodies of the transport group, so that the spring body lying at the upper end of the upwardly leading ramp is urged above and beyond the adjacent apex line and onto the upper end of the downwardly leading ramp which follows. The spring body thus joins the supply group collected on this ramp so long as such is not the discharge ramp. During the preliminary stroke, the slide prevents the spring body lying at the lower end of the downwardly leading ramp from arriving against the lower end of the upwardly leading ramp. This spring body remains against the slide. During the return stroke of the slide to its rest position, which stroke takes place with a short pause after the preliminary stroke, the transport group falls back slightly with the slide without the spring body which was delivered over the top, until the lowermost body on the upwardly leading ramp is engaged by the upper side of the adjacent end of the leaf spring which acts as a return stop, so that the spring lying at the lower end of the downwardly leading ramp can then proceed toward the previously emptied space at the lower end of the upwardly leading ramp, when the slide has retracted far enough to allow this. The described process is repeated periodically with intermediate pauses and takes place in all transfer intervals simultaneously.

The stop arranged in the first forming station, which engages the spring body downstream of the freed holding device in the first forming station, which spring body was separated in the first forming interval from the transport group, temporarily prevents this spring body from joining the supply group in the second transfer interval. After the first eyelet has been formed, the holding device and the stop in the first forming station are raised, whereupon the separated spring body provided with one eyelet becomes the uppermost spring body of the supply group in the second transfer interval. The separation of the spring body which has arrived at the upper end of the upwardly leading ramp takes place in this second transfer interval in a different manner. Here the separately controlled holding device in the second forming station moves, together with the associated stop, in a downward direction when the center slide begins its return stroke. The stop prevents the spring body to be separated from moving slightly backward on the upward leading ramp. During the next preliminary stroke of the slide, the stop in the second forming station is no longer in the path of the transport group, so that the spring body lying at the upper end of the upwardly leading ramp in a second transfer interval is raised above the adjacent apex line and is transferred to the following downwardly leading ramp.

In both forming stations, the separated spring body, which is to be provided with an eyelet and which is gripped by the stop and is thereby stationary, is pressed by the adjacent holding device against its arm with a light force to permit rotation of the spring body. The activation of the piston-cylinder of the first or second rotation device then places the forming station in operation. The pneumatic rotator pushes the spring body against the rotation stop of the forming station in an axial direction until it strikes thereagainst, whereupon the maximal rotation of the spring body which can result in a rotation is undertaken in the rotational position determined by the rotation stop, until the wire end is brought to a standstill against the rotational stop. When the predetermined rotational position is attained, the rotating receiving element of the rotation device stops. When the piston-cylinder is activated in the opposite sense, the operation of the rotational device is stopped. The forming device then begins to operate in a known manner. After the forming of the eyelet, the holding device and the stop are raised, whereupon the separated spring body which has been provided with an eyelet either joins the next supply group or again joins the transport group it has just left.

The winding device produces spring bodies in a known manner, which it passes on successively to the first downwardly leading ramp, whereby the supply group in the first transfer interval is continually renewed. At the other end of the machine, finished spiral springs roll successively down the discharge ramp in the same cycle at which the winding device is operating. Between the winding device and the discharge ramp, the spring bodies follow closely next to each other, the only exception being in the area of the return stops and the forming stations. The control shaft of the additional unit need not operate with the same rpm as the winding device. The rpm can be different when, as in the exemplary embodiment, it is desired that the winding device and the additional unit operate in the same cycle, because the gear brake motor of the additional unit, as stated above, is turned on by the control shaft of the winding device.

Figure 8:
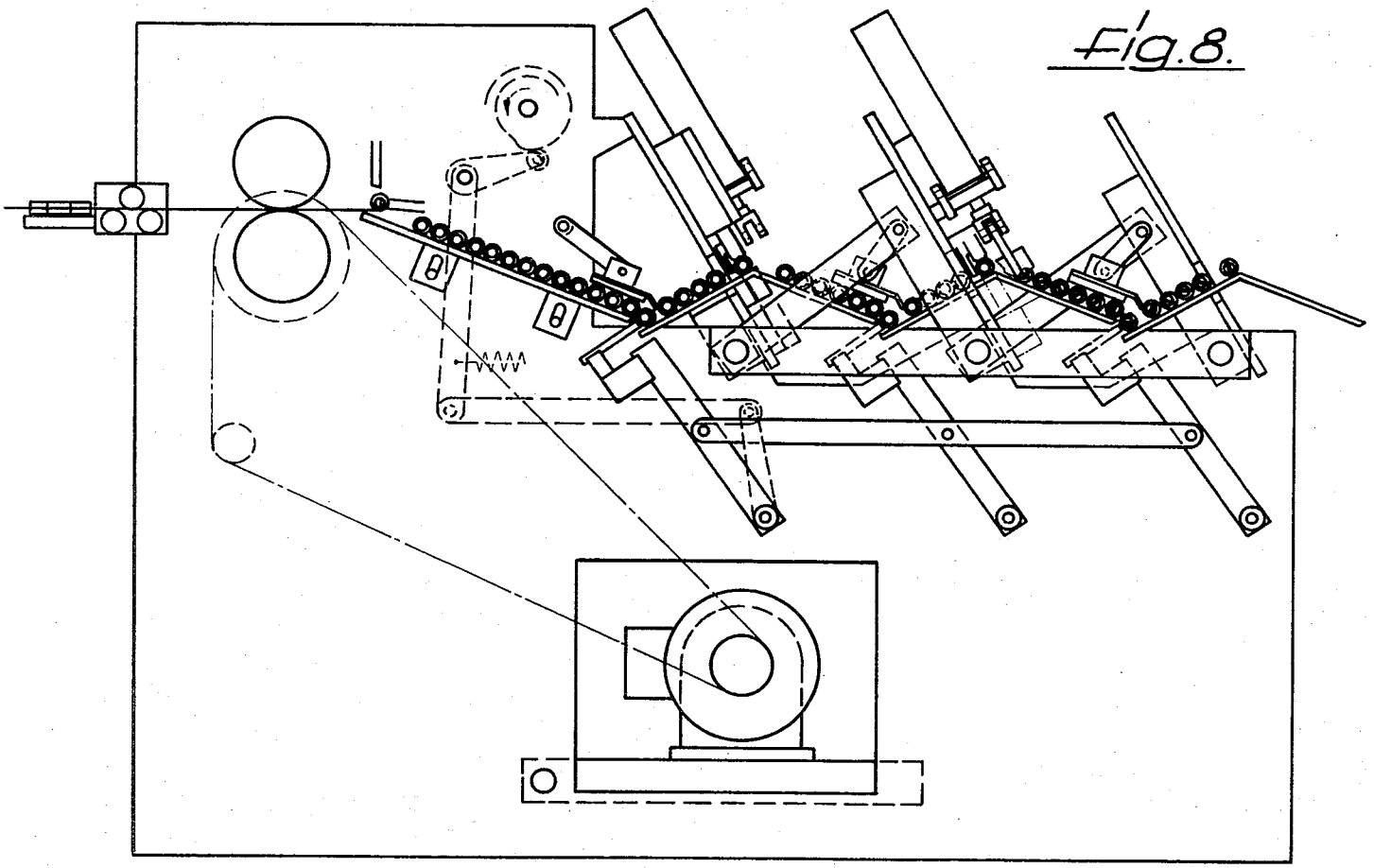
FIG. 8 is a front view of the variation according to FIG. 1.

The variation of the exemplary embodiment shown in FIG. 8 is distinguished therefrom mainly by the following characteristics: The entire machine is one structural unit, the winding device on the one hand and the delivery devices and the forming devices on the other hand operate from a common control shaft, whereby the rolling work of the cam mechanism is coupled with the pivot arm of one of the delivery mechanisms by a linkage, and the two forming devices are formed as mirror images of each other and are arranged in the same manner at locations of the two first transfer intervals corresponding to each other.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. In a process for producing coil springs formed of wire and having eyelets, in which a spring body is wound from a length of wire in a winding station, said eyelets being formed on each end of the spring body in two forming stations, spring bodies, prior to the formation of the eyelets, being transferred from the winding station into a first forming station for forming one eyelet, the spring body provided with one eyelet being thereafter transferred from the first forming station to a second forming station for forming the other eyelet, the improvement comprising the steps of:

successively arranging a plurality of spring bodies between two successive forming stations with the axes of said spring bodies parallel to each other, transferring a transport group of spring bodies comprising at least some of said spring bodies in a step-like manner at right angles to the direction of their axes in a straight line, stepwise maintaining the transport group of spring bodies by separating the spring body of said transport group arriving at one of said forming stations and supplying a further spring body to said transport group, wherein the transport group is formed only by some of the successively arranged spring bodies and transferring the transport group generally upwardly and wherein a supply group is formed from some of the remaining spring bodies and transferring the supply group by gravity, and step-wise maintaining the supply group by separating the spring body of said supply group at a transport group and by supplying a further spring body one-by-one directly from the winding station to a rear end of said supply group without passing through an intermediate hopper or container.

2. The process according to claim 1, wherein the spring body of the transport is separated by moving the same over an unstable support.

3. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising:

said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes, wherein said spring bodies include both transport groups and supply groups of spring bodies, said transfer means including a ramp downwardly inclined in the delivery direction for a supply group of spring bodies and a ramp upwardly inclined in the delivery direction for a transport group of spring bodies, said ramps together defining an obtuse interior angle and being disposed relative to each other to define an intermediate space therebetween, and said delivery means including a slide extending through said space for moving a transport group of spring bodies step-wise along said upwardly inclined ramp.

4. In an apparatus for producing coil springs, formed of wire and having eyelets, comprising means for winding spring bodies form a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising: said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes;

said spring bodies comprising transport groups and supply groups of spring bodies, said transfer means including a ramp downwardly inclined in the delivery direction for a supply group of spring bodies and a ramp upwardly inclined in the delivery direction for a transport group of spring bodies, said ramps together defining an obtuse interior angle and being disposed relative to each other to define an intermediate space therebetween, said delivery means including a slide extending through said space for moving a transport group of spring bodies step-wise along said upwardly inclined ramp; and including a leaf spring having a free end arranged adjacent the intermediate space of the two ramps, the free end of said spring engaging between the last and next to last spring bodies of the transport group to prevent the spring bodies of the transport group from traveling in an upstream direction.

5. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising: said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes;

said spring bodies comprising transport groups and supply groups of spring bodies, said transfer means including a ramp downwardly inclined in the delivery direction for a supply group of spring bodies and a ramp upwardly inclined in the delivery direction for a transport group of spring bodies, said ramps together defining an obtuse interior angle and being disposed relative to each other to define an intermediate space therebetween, said delivery means including a slide extending through said space for moving a transport group of spring bodies stepwise along said upwardly inclined ramp; and the upwardly inclined rmp of one transfer means and the downwardly inclined ramp of the following transfer means are joined to each other along a dividing line, one of the forming stations being arranged at said dividing line.

6. The improvement according to claim 5, wherein the two joined ramps are formed in one piece and means pivotally mounting said joined ramps including a horizontal rod and a holder pivotally arranged on said rod.

7. The improvement according to claim 5, wherein each forming means includes spring body gripping means arranged adjacent the dividing line of the joined ramp sections associated therewith for gripping a spring body, said gripping means including a gripper reciprocable at right angles to one of the ramp sections and a spring support arranged in said one ramp section.

8. The improvement according to claim 7, wherein each forming means includes means arranged adjacent the dividing line of the joined ramp sections for stopping a spring body and means connected to said stop means for reciprocating the stop means at right angles to one of said ramp sections.

9. The improvement according to claim 8, wherein said stop means is carried by the gripping means associated therewith, the stop means and gripping means of one of said forming means being arranged at the uppermost end of the downwardly inclined ramp associated therewith and the stop means and gripping means of the other forming means being arranged at the uppermost end of the upwardly inclined ramp associated therewith.

10. The improvement according to claim 9, wherein said one forming means is said first forming means and said other forming means is said second forming means.

11. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising: said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes; and said delivery means each including a pivot arm and a slide adjustably attached to said pivot arm, coupling rod means connected to the pivot arm of each delivery means for synchronously pivoting said pivot arms, common drive means connected to said coupling rod means for driving said delivery means, said drive means including a control shaft, a cam arranged on said control shaft, a cam follower connected with one of said pivot arms and means for rotating said control shaft in intermittent single revolutions.

12. The improvement according to claim 11, wherein said cam follower includes a spring-biased lever having a roller bearing on said cam, a connecting strap connected between one of said pivot arms and a selected point on said lever.

13. The improvement according to claim 11, wherein said rotating means for the control shaft comprises a gear brake motor and a belt or drive chain connected between said motor and said control shaft.

14. The improvement according to claim 9, wherein: said control shaft includes a rotatable shaft of said winding means.

15. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising:

said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes, wherein said first and second forming means are substantially identical and are arranged on opposite longitudinal sides of the transfer means in staggered relation in the direction of delivery of the spring bodies.

16. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising: said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes;

said first and second forming means being substantially identical and being arranged on opposite longitudinal sides of the transfer means in staggered relation in the direction of delivery of the spring bodies; and including a first and second horizontal rod and strap means for mounting the first and second forming means on a respective horizontal rod.

17. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising:

said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes, wherein said first and second forming means includes first and second rotating means for rotating a spring body transferred to the respective forming means about its axis into a predetermined rotational position determined by a stop, wherein said rotating means are identically formed, said first forming means and first rotating means are arranged on a longitudinal side of the transfer means opposite said second forming means and second rotating means.

18. In an apparatus for producing coil springs, formed of wire and having eyelets, comprising means for winding spring bodies from a length of wire, first and second means for forming eyelets on the ends of a spring body in a respective first and second forming station, and first means for transferring the spring body, prior to the formation of the eyelets, from the winding means to the first forming station, and second means for transferring spring bodies after the formation of one eyelet from the first forming station to the second forming station, and third means for transferring spring bodies with two eyelets from the second forming station, the improvement comprising:

said transfer means each including at least one inclined ramp which terminates at a respective forming station, some of said spring bodies forming transport groups arranged on the inclined ramps adjacent each other with parallel axes and means associated with each transfer means for the step-wise delivery of a group of spring bodies along said transfer means at right angles to the direction of their axes, wherein said first and second forming means includes first and second rotating means for rotating a spring body transferred to the respective forming means about its axis into a predetermined rotational position determined by a stop, wherein each rotating means includes a pneumatic rotator and means for reciprocating said rotator parallel to the axis of a spring body to be rotated, said rotator having means for receiving an end of said spring body to be rotated.

19. The improvement according to claim 18, wherein the receiving means of one rotating means comprises a stud having a radial carrier pin for engaging a spring body end.

20. The improvement according to claim 19, wherein the receiving means of the other rotating means comprises a hollow body having a radially inwardly extending carrier pin for engaging an eyelet at the end of a spring body.

21. The improvement according to claim 20, wherein the rotating means having the stud is the first rotating means and the rotating means having the hollow body is the second rotating means.

22. The improvement according to claim 18, wherein said means for reciprocating said rotating means comprises a pneumatic piston and cylinder, said piston having a piston rod connected with said rotator.

23. The improvement according to claim 22, wherein the receiving means of one rotating means comprises a stud having a radial carrier pin for engaging a spring body end and wherein the receiving means of the other rotating means comprises a hollow body having a radially inwardly extending carrier pin means for engaging an eyelet at the end of a spring body.

* * * * *

UNITED STATES PATENT AND TRADEMARK OFFICE

CERTIFICATE OF CORRECTION

PATENT NO. : 4,236,397

DATED : December 2, 1980

INVENTOR(S) : GERHARD LANGE

It is certified that error appears in the above-identified patent and that said Letters Patent are hereby corrected as shown below:

Claim 2, column 12, line 11, after "transport", insert -- group --.

Claim 4, column 12, line 51, change "form" to -- from --.

Claim 5, column 13, line 53, change "rmp" to -- ramp --.

Claim 14, column 14, line 59, change "9" to -- 11 --.

Signed and Sealed this

*Fifth* Day of *May 1981*

[SEAL]

*Attest:*

RENE D. TEGTMEYER

*Attesting Officer*

*Acting Commissioner of Patents and Trademarks*